US007150233B1

(12) United States Patent
Eberhart

(10) Patent No.: US 7,150,233 B1
(45) Date of Patent: Dec. 19, 2006

(54) JACKETED BOAT-TAIL BULLET

(75) Inventor: Gerald Todd Eberhart, Bethalto, IL (US)

(73) Assignee: Olin Corporation, East Alton, IL (US)

( * ) Notice: Subject to any disclaimer, the term of this patent is extended or adjusted under 35 U.S.C. 154(b) by 59 days.

(21) Appl. No.: 10/832,082

(22) Filed: Apr. 26, 2004

(51) Int. Cl.
*F42B 12/04* (2006.01)

(52) U.S. Cl. ..... 102/516; 102/518

(58) Field of Classification Search ..... 102/514, 102/515, 516, 517, 518, 519
See application file for complete search history.

(56) References Cited

U.S. PATENT DOCUMENTS

| | | | | | |
|---|---|---|---|---|---|
| 1,961,076 | A * | 5/1934 | Page | 86/54 |
| 3,357,357 | A * | 12/1967 | Voss | 102/516 |
| 3,720,170 | A * | 3/1973 | Godfrey | 102/516 |
| 4,619,203 | A * | 10/1986 | Habbe | 102/516 |
| 4,625,650 | A * | 12/1986 | Bilsbury | 102/516 |
| 5,399,187 | A | 3/1995 | Mravic et al. | 75/228 |
| 5,535,678 | A * | 7/1996 | Brown | 102/439 |
| 6,085,661 | A | 7/2000 | Halverson et al. | 102/516 |
| 6,112,669 | A | 9/2000 | Mravic et al. | 102/501 |
| 6,182,574 | B1 * | 2/2001 | Giannoni | 102/516 |
| 6,374,743 | B1 * | 4/2002 | Hug et al. | 102/518 |
| 6,973,879 | B1 * | 12/2005 | McElroy et al. | 102/514 |
| 2005/0183617 | A1 * | 8/2005 | MacDougall | 102/514 |

* cited by examiner

*Primary Examiner*—Michael J. Carone
*Assistant Examiner*—James S. Bergin
(74) *Attorney, Agent, or Firm*—Harness, Dickey & Pierce, P.L.C.

(57) ABSTRACT

A bullet includes at least a mid core and a rear core in tandem alignment. The hardness of the mid core is greater than the hardness of the rear core. A jacket envelops both the mid core and the rear core. The jacket has a generally cylindrical sidewall, which is in contact with the mid core, and a boat-tail, which is in contact with the rear core. The rear core is substantially contained within the boat-tail. The mid core and the rear core may be substantially lead-free. In one embodiment, the bullet includes a front core in tandem alignment with the rear core and in contact with a nose portion of the jacket. In another embodiment, the mid core extends from the nose portion of the bullet to the boat-tail.

15 Claims, 3 Drawing Sheets

JACKETED BOAT-TAIL BULLET

BACKGROUND OF THE INVENTION

1. Field of the Invention

This invention relates to small arms ammunition and, more particularly, to jacketed, boat-tailed bullets.

2. Description of the Related Art

Jacketed bullets include a layer of metal, called a jacket, surrounding at least a portion of a core of the bullet. The core is typically made of lead. It is well known that the heel of a jacketed bullet may be tapered to form what is known as a boat-tail (BT), which acts to enhance the bullet's ballistic stability and to improve the bullet's aerodynamic performance.

Examples of jacketed, boat-tailed bullets can be found in small caliber, 0.5 inch and under, penetrator projectiles used by military forces worldwide. For example, the United States and NATO military forces use vast quantities of M855 cartridges containing 62 grain penetrator bullets, one of which is depicted generally at 10 in FIG. 1. As shown in FIG. 1, the M855 bullet 10 has two aligned cores 12 and 14 enveloped by a brass jacket 16. A steel core 12 is located in a nose section 18 of the bullet 10 and a 32 grain lead core 14 is swaged into a rear section 20. The bullet 10 has a heel that is tapered to form a boat-tail 22, which provides the bullet 10 with ballistic stability and improved aerodynamic performance. In this case, the boat-tail 22 extends from a bearing surface 24 of the bullet 10 to a base 26 of the bullet 10. At a total weight of 62 grains, the M855 bullet 10 has the kinetic energy required to penetrate a 10 gage steel plate when fired from a distance of 600 meters.

In the M885 bullet 10, the steel front core 12 is used to provide the integrity necessary to promote penetration against light armored targets. The lead rear core 14 allows the projectile weight to be obtained using the lowest cost heavy metal available. In addition, the malleable lead material can be conveniently compacted inside the bullet jacket 16 to form a true, cylindrical bearing surface 24 diameter, while producing a consistent form and closure of the boat-tail 22 of the bullet 10. It is this boat-tail 22 forming operation and heel closure that has a significant impact on improving the projectile's stability during launch and, therefore, the accuracy of the bullet 10.

Many of these penetrator rounds are expended at target ranges in military drills. The large volume of lead contained within the projectiles makes environmental reclamation of the target ranges difficult and expensive. Accordingly, various attempts have been made to produce effective lead-free bullets.

For example, U.S. Pat. No. 5,399,187 to Mravic, et al. is directed to lead-free bullets having a density similar to that of lead. The lead-free bullets comprise a compacted composite containing a high-density first constituent selected from the group consisting of tungsten, tungsten carbide, ferro-tungsten and mixtures thereof; and a lower density second constituent selected from the group consisting of tin, zinc, aluminum, iron, copper, bismuth, and mixtures thereof, wherein the density of the lead-free bullet is in excess of 9 grams per cubic centimeter and the lead-free bullet deforms or disintegrates at a stress of less than about 45,000 psi. U.S. Pat. No. 5,399,187 is incorporated by reference herein in its entirety.

In another example, U.S. Pat. No. 6,112,669 to Mravic, et al. is directed to a lead-free projectile made from a composition containing about 5–25% by weight tungsten and more than about 97% by weight tungsten plus iron. U.S. Pat. No. 6,112,669 is incorporated by reference herein in its entirety.

In yet another example, U.S. Pat. No. 6,085,661 to Halverson, et al. discloses a small caliber non-toxic penetrator projectile that has a first core and a second core tandemly aligned and enveloped by a jacket. The first core has a hardness greater than the hardness of the second core, which has a Brinell hardness of between about 20 and about 50. The hardness of the second core is significantly higher than the hardness of lead, and when the first core strikes a target, the second core resists compressive bulging. As a result, more kinetic energy is transferred to the first core rather than being diffused along the surfaces of an armored target. U.S. Pat. No. 6,085,661 is incorporated by reference herein in its entirety.

While various non-toxic metals have proven to be successful replacements for lead in the manufacture of bullets, these non-toxic metals are not without their shortcomings. For example, many non-toxic metals have a hardness greater than lead, which makes the non-toxic metal more difficult to form in the bullet manufacturing process. Where the bullet is to be formed with a boat-tail, excessive material hardness make the mechanical swaging processes utilized in standard bullet manufacture ineffective to form the boat-tail. The boat-tail must then be cut or ground into the rear of the core and, during mechanical enveloping of the jacket around the excessively hard core, there is limited impinging of the jacket with the core. The result is a gap between the jacket and the boat-tail. When this projectile is fired, propellant gasses are forced between the interface of the jacket and the core causing distortion of the jacket and resulting in loss of accuracy and stability. Thus, a new approach is needed to obtain a bullet that is completely devoid of lead while performing ballistically similarly to lead with the manufacturing advantages of lead.

BRIEF SUMMARY OF THE INVENTION

The above-described drawbacks and deficiencies of the prior art are overcome or alleviated by a bullet including at least a mid core and a rear core in tandem alignment, with the hardness of the mid core being greater than the hardness of the rear core. A jacket envelops both the mid core and the rear core. The jacket has a generally cylindrical sidewall, which is in contact with the mid core, and a boat-tail, which is in contact with the rear core. The rear core is substantially contained within the boat-tail. The mid core and the rear core may be substantially lead-free. In one embodiment, the bullet includes a front core in tandem alignment with the mid core and in contact with a nose portion of the jacket. The rear core may substantially fill the boat-tail. In various embodiments, a transition point between the generally cylindrical sidewall and the boat-tail may be formed by a rebate in the generally cylindrical sidewall.

In various embodiments, the mid core is formed from a high-density constituent material selected from the group of tungsten, tungsten carbide, carballoy, and ferro-tungsten; and a second, lower-density constituent consisting of either a metallic matrix material or a plastic matrix material. The metallic matrix material may be selected from the group consisting of: tin, zinc, iron, copper, and mixtures or alloys of one or more of the foregoing. The plastic matrix material may be selected from the group consisting of: phenolics, epoxies, dialphthalates, acrylics, polystyrenes, polyethylene, or polyurethanes. Alternatively, the mid core may be formed from one of: copper, bismuth, tin, gold, silver, pewter, bronze and mixtures or alloys including one or more of the foregoing, or from an organic polymer filled with a metal.

In various embodiments, the rear core has a Brinell hardness less than about 50. The rear core may be formed from tin or a tin base alloy. Alternatively, the rear core may be formed from one of: copper, zinc, tin and alloys or mixtures including one or more of the foregoing.

In various embodiments, the bullet further includes a front core in tandem alignment with the mid core, with the front core being positioned adjacent to the nose portion. The front core may be formed from steel.

BRIEF DESCRIPTION OF THE DRAWINGS

The invention will be more fully understood from the following detailed description taken in conjunction with the accompanying drawings wherein like elements are numbered alike, and in which.

DETAILED DESCRIPTION

Figure 2:
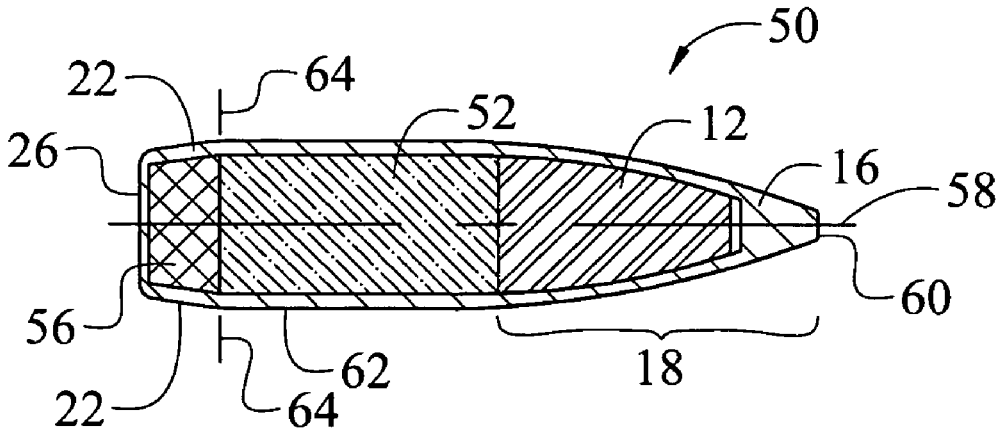
FIG. 2 is a longitudinal, cross-sectional view of a jacketed, boat-tailed bullet in accordance with one embodiment of the present invention.

FIG. 2 is a longitudinal, cross-sectional view of a lead-free, jacketed, boat-tail bullet (projectile) 50 configured in accordance with one embodiment of the present invention. In the embodiment shown, the bullet 50 is formed as a penetrator bullet as may be used in an M855 cartridge. The bullet 50 has a front core 12, a mid core 52, and a rear core 56 tandemly arranged along a longitudinal axis 58 of the projectile.

Enveloping the front, mid, and rear cores 12, 52 and 56 is a jacket 16, which may be formed from any convenient material such as, for example, brass (a copper/zinc alloy), copper plated steel, and the like. In the embodiment shown, the jacket 16 has an ogival nose portion 18 adjacent to a forward end of the front core 12, with the nose portion 18 having a closed, flattened tip 60 forming a small meplat or protected tip. The jacket 16 is crimped around a rearward end of the rear core 56 to form a base 26 of the bullet 50. As used herein, the forward end refers to the end portion of a component that is closer to the tip 60 of the projectile during flight. The rearward end refers to the opposing portion of the component that is further from the tip 60 of the projectile during flight.

Adjacent to the base 26 of the bullet, a sidewall of the brass jacket 16 is angularly indented for improved ballistic stability and aerodynamic flight including reduced air drag. This configuration is referred to as a boat-tail, and is indicated at 22. Disposed between the boat-tail 22 and the nose portion 18 is a generally cylindrical mid-body sidewall 62. The outside diameter of the mid-body sidewall 62 (i.e., the caliber) defines the bearing surface of the bullet 50, which contacts the rifling of a gun barrel as the bullet 50 is fired through the gun barrel.

In the bullet 50, the mid core 52 is relatively harder than the rear core 56. By relatively harder, it is meant that when the hardness is evaluated by standard testing means, at room temperature, the mid core 52 is harder than the rear core 56.

Suitable materials for the front core 12 include steel, tungsten and tungsten carbide. Preferred materials for the mid core 52 include tungsten base composites. As used herein, the term "base" means that the composite or alloy contains at least 50%, by weight, of the material specified (e.g., tungsten). Examples of tungsten base composites are described in U.S. Pat. No. 5,399,187 to Mravic, et al., which is incorporated by reference herein in its entirety. Such materials include a sintered composite having one or more high-density constituent powder materials selected from the group consisting of tungsten carbide, tungsten, ferro-tungsten and carballoy, and a second, lower-density constituent consisting essentially either of a metallic matrix material selected from the group consisting of tin, zinc, iron, copper, and mixtures or alloys of one or more of the foregoing, or a plastic matrix material selected from the group consisting of phenolics, epoxies, dialyphthalates, acrylics, polystyrenes, polyethylene, or polyurethanes. In addition, the composite of either type may contain a filler metal such as iron powder or zinc powder. Other constituents could also be added in small amounts for special purposes, and lubricants and/or solvents could also be added to the metal matrix components to enhance powder flow properties, compaction properties, ease of die release, etc.

Other suitable materials for the mid core 52 include copper and copper alloys, bismuth/tin alloys, gold, silver, pewter (a tin/antimony/copper alloy), bronze (a copper/tin alloy), and organic polymers, such as nylon or rubber, filled with a powdered heavy metal, such as tungsten or copper. Yet other materials for the core 52 include an annealed copper alloy, such as the copper alloy designated by the Copper Development Association (CDA) as copper alloy C10200 (99.95%, by weight, minimum copper).

Rear core 56 is formed from a malleable material, which preferably has a Brinell hardness less than about 50 HB when measured in accordance with American Society for Testing and Materials (ASTM) standard E10-01, Standard Test Method for Brinell Hardness of Metallic Materials, using a 500 kg load, 10 mm ball, and 10–15 second dwell time. The Brinell hardness assigns a number, HB, related to the applied load and to the surface area of the permanent impression made by a ball indenter computed from the equation:

$$HB=2P/(\pi D(D-(D^2-d^2)^{0.5}))$$

Where:

P=the applied load in kilogram-force,

D=the diameter of an indenting ball in millimeters, and d=the mean diameter of a formed impression in millimeters.

With a Brinell hardness less than about 50 HB, a mechanical swaging process utilized in standard bullet manufacture is effective in providing a consistent boat-tail 22 form and adequate bullet heel closure. Advantageously, the use of the rear core 56 allows the material of the front and mid cores 12 and 52 to be selected based on ballistic (e.g., weight, density, bullet penetration) or other requirements, while the rear core 56 will provide sufficient malleability to ensure that the boat-tail 22 is properly shaped and that sufficient impinging of the jacket 16 with the core (i.e. sufficient bullet heel closure) occurs to prevent propellant gasses from entering the interface between the jacket 16 and the rear core 56.

Accordingly, the rear core 56 eliminates the distortion of the jacket 16 and resulting loss in accuracy and stability associated with gas penetration.

A preferred material for the core rear 56 is tin or tin base alloys, where "base" means that the alloy contains at least 50%, by weight, of tin. Alternative materials include copper, copper alloys, bronze, zinc, and mixtures or alloys including one or more of the foregoing in an annealed or un-annealed state that provides the malleability to offer adequate boat-tail 22 form and bullet heel closure. Other alternative materials include non-metallic materials such as polymers and the like.

Preferably, the rear core 56 is substantially contained within the boat-tail 22 of the bullet 50. By "substantially contained within the boat-tail," it is meant that the forward end of the rear core 56 preferably extends no more than about one quarter of the caliber of the bullet (0.25× caliber) forward of a transition point 64 between the boat-tail 22 and the bearing surface 62 of the bullet. It will be recognized that, because of the relatively low hardness of the rear core 56 compared to the front and mid cores 12 and 52, if the rear core 56 is not substantially contained within the boat-tail 22 (i.e., if the rear core 56 extends substantially into the area defined within the bearing surface 62 of the bullet 50), bulging of the rear core 56 may cause bearing surface 62 deformation when the bullet 50 is fired. In addition, if the rear core 56 is not substantially contained within the boat-tail 22, the bullet 50 may experience a greater loss of kinetic energy upon impact with a target due to excessive deformation or splatter of the relatively soft rear core 56. As described in U.S. Pat. No. 6,085,661 to Halverson, which is incorporated by reference herein in its entirety, the loss of kinetic energy due to such excessive deformation or splatter can diminish the penetrating ability of the front core 12.

Preferably, the rear core 56 substantially fills the boat-tail 22 of the bullet 50. By "substantially fills the boat-tail," it is meant that the rear core 56 fills an area defined by an inside surface of the jacket 16 between the base 26 of the bullet 50 and the rearward end of the mid core 52, with the forward end of the rear core 56 being no less than about one quarter of the caliber of the bullet 50 (0.25× caliber) rearward of the transition point 64 between the boat-tail 22 and the bearing surface 62 of the bullet 50. With the rear core 56 substantially filling the boat-tail 22, the entire boat-tail 22 may be properly shaped during the bullet forming process.

In general, the density of each of the front, mid, and rear cores 12, 52 and 56 is determined in light of the desired application of the bullet 50. Where the bullet 50 is to be a lead-free replacement for the 62 grain penetrator bullet 10 used in an M855 cartridge, shown in FIG. 1, it has been determined that a tungsten base composite core material with a weight of about 30 grains is preferred for the mid core 52, and a weight of about 4.3 grains is preferred for the rear core 56. The jacket 16 and the front core 12 of the lead-free replacement bullet 50 are preferably identical to those found in the existing 62 grain penetrator bullet 10 of the M855 cartridge. In this configuration, the bullet 50 has substantially the same dimensions and weight as the 62 grain penetrator bullet used in an M855 cartridge. It is contemplated that the present embodiment may be applied to bullets of similar design in various grain weights within a given caliber (e.g., a 5.56 millimeter, 55 grain bullet). It is also contemplated that the present embodiment applies to other calibers, most notably the 7.62 millimeter 147 grain bullet used in the M80 cartridge, up to and including 50 caliber.

Figure 3:
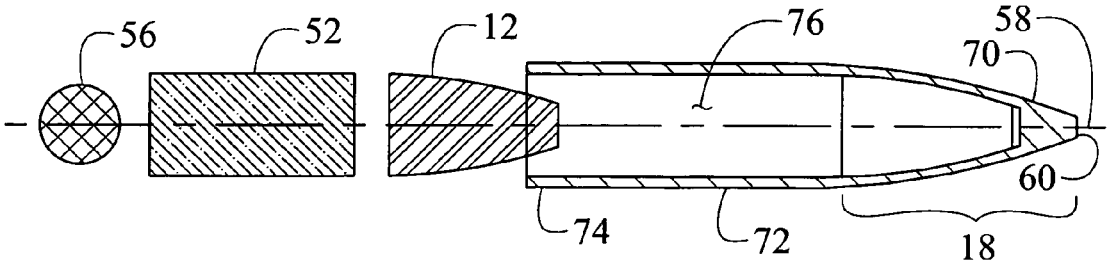
FIG. 3 is a longitudinal, cross-sectional view of components of the jacketed, boat-tailed bullet of FIG. 2 during manufacture.

A method for the manufacture of the bullet 50 can be described with reference to FIG. 3. In the method, a jacket precursor 70 is formed from a malleable metal. The jacket precursor 70 may be formed with an ogival nose 18, cylindrical mid-body sidewall 72, and a rear sidewall 74. The front core 12 is processed to a first hardness that is greater than the hardness of the mid core 52. If the front core 12 is steel, the desired hardness may be achieved by a thermal process such as carburizing or work hardening.

Front and mid cores 12 and 52 are then sequentially inserted into a cavity 76 defined by the jacket precursor 70, with the front core 12 being deposited adjacent to the ogival nose 18. While the rear end of the front core 12 may be bonded to the front end of the mid core 52, in preferred embodiments, the front and mid cores 12 and 52 are in abutting, but not affixed, relationship.

After the front and mid cores 12 and 52 are inserted into the cavity 76, the rear core 56 is deposited into a portion of the cavity 76 formed by the rear sidewall 74. Preferably, the rear core 56 is manufactured in a spherical shape for ease of feeding during the bullet assembly process; alternatively, the rear core 56 is manufactured in slug form from wire, or blanked from strip.

After the rear core 56 is inserted into the cavity 76, a swaging die or other mechanical deforming apparatus then deforms the jacket precursor 70 into an effective jacket 16 as described above in reference to FIG. 2. A crimp is formed from the rear sidewall 74 and mechanically secures the front, mid and rear cores 12, 52, and 56 in position. The mechanical deforming step further deforms both the jacket precursor 70 and the rear core 56 to form a boat-tail 22.

Figure 4:
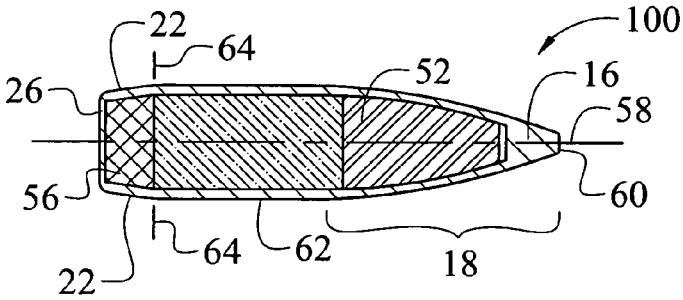
FIG. 4 is a longitudinal, cross-sectional view of a jacketed, boat-tailed bullet in accordance with another embodiment of the present invention.

Referring to FIG. 4, a longitudinal, cross-sectional view of a lead-free, jacketed, boat-tail bullet 100 configured in accordance with another embodiment of the present invention is shown. The bullet 100 has a mid core 52 and a rear core 56 tandemly arranged along a longitudinal axis 58 of the projectile. This embodiment is substantially similar to the embodiment described with reference to FIG. 2, with the exception that the front core 12 of FIG. 2 has been removed and the mid core 52 now extends from the nose portion 18 of the bullet 100 to the boat-tail portion 22. The method for manufacturing the bullet 100 is also substantially similar to that described above for the bullet 50, with the exception that the steps related to the front core 12 of bullet 50 are no longer necessary. The bullet 100 of FIG. 4 may be formed as a penetrator bullet as may be used in an M855 cartridge. The bullet 100 may alternatively be formed as a frangible bullet, as may be used for shooting ranges.

Figure 1:
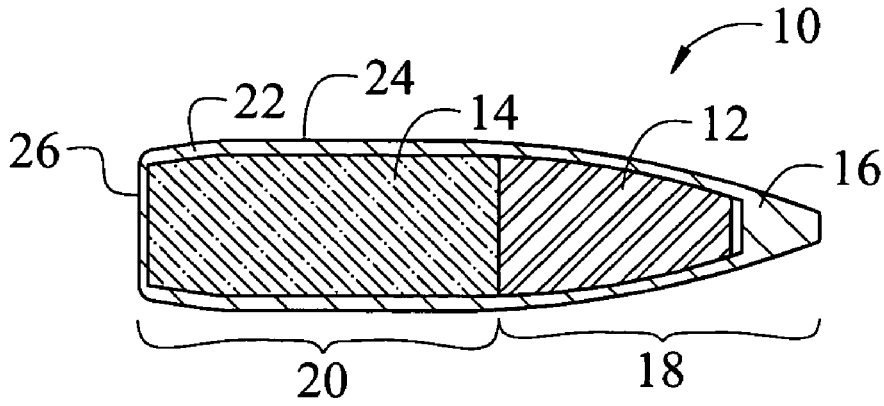
Fig. 1 (Prior Art)
FIG. 1 is a longitudinal, cross-sectional view of a jacketed, boat-tailed bullet of the prior art.

In the embodiment of FIG. 4, the mid core 52 is relatively harder than the rear core 56. In general, the mid and rear cores 52 and 56 may be configured using the same materials, hardnesses, and densities described above with reference to the embodiment of FIG. 2. However, where the bullet 100 is to be a lead-free replacement for the 62 grain penetrator bullet used in an M855 cartridge, shown in FIG. 1, it has been determined that a tungsten base composite core material with a weight of about 38 grains is preferred for the mid core 52, and a weight of about 4.3 grains is preferred for the rear core 56. The jacket 16 of the lead-free replacement bullet 100 is preferably identical to that found in the existing 62 grain penetrator bullet 10 of the M855 cartridge, as shown in FIG. 1, and the front core 12 is removed. In this configuration, the bullet 100 has substantially the same dimensions and weight as the 62 grain penetrator bullet used in an M855 cartridge. It is contemplated that the present embodiment may be applied to bullets of similar design in various grain weights within a given caliber (e.g., a 5.56 millimeter, 55 grain bullet). It is also contemplated that the present embodiment applies to other calibers, most notably the 7.62 millimeter 147 grain bullet used in the M80 cartridge, up to and including 50 caliber.

Where the bullet 100 is to be configured as a frangible bullet, other constituents may be added to the tungsten base composite of mid core 52 to enhance frangibility. For example, as described in U.S. Pat. No. 5,399,187 to Mravic, et al., carbon could be added if iron is used as one of the composite components to result in a brittle or frangible microstructure after suitable heat treatment processes.

Figure 5:
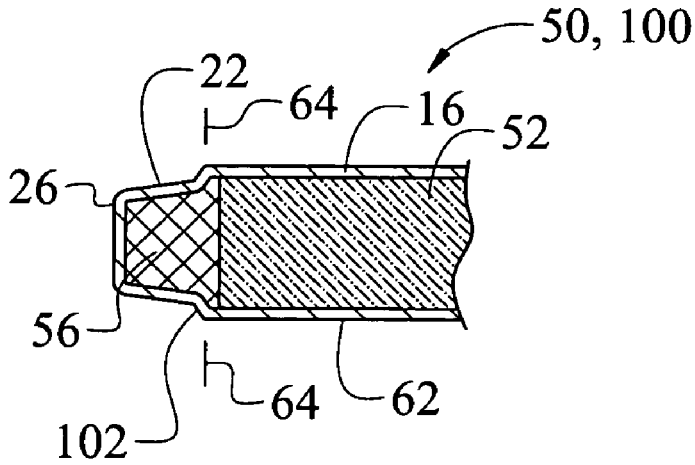
FIG. 5 is a longitudinal, cross-sectional view of a portion of a jacketed, rebated boat-tailed bullet in accordance with other embodiments of the present invention.

In the bullets 50 and 100 described herein, the boat-tail 22 is shown extending from the bearing surface 62 to the base 26. Alternatively, as shown in FIG. 5, it is contemplated that, in either bullet 50 or 100, the boat-tail 22 may extend from a rebate 102 in the bearing surface 62 to the base 26 to form what is known as a rebated boat-tail (RBT). In this embodiment, the transition point 64 between the bearing surface 62 and the boat tail 22 is the rebate 102.

The bullets 50 and 100 described herein employ a rear core 56, which ensures a consistent boat-tail 22 form and adequate bullet heel closure. The use of the rear core 56 allows the material of the front core 12 and/or the mid core 52 to be selected based on ballistic (e.g., weight, density, bullet penetration) or other requirements, while the rear core 56 will provide sufficient malleability to ensure that the boat-tail 22 is properly shaped and provides sufficient impinging of the jacket 16 with the rear core 56 (i.e., bullet heel closure) to prevent propellant gasses from entering the interface between the jacket 16 and the rear core 56. Accordingly, the rear core 56 eliminates the distortion of the jacket 16 and resulting loss in accuracy and stability associated with gas penetration. Where the rear core 56 is substantially contained within the boat-tail 22 of the bullet 50 or 100, bearing surface 62 deformation is avoided when the bullet 50 or 100 is fired. In addition, where the rear core 56 is substantially contained within the boat-tail 22, the bullet 50 or 100 will experience less loss of kinetic energy upon impact with a target, and thus greater penetration, than if a larger rear core 56 were used.

One or more embodiments of the present invention have been described. Nevertheless, it will be understood that various modifications may be made without departing from the spirit and scope of the invention. For example, while the bullets 50 and 100 are described herein as having an ogival nose 18, other nose shapes may be used as well. For example, nose 18 may be spire (conical) shaped. Similarly, while the tip 60 of the nose 18 is shaped to include a small meplat or protected tip, it will be appreciated that other tip shapes may be used. For example, the tip 60 may be shaped to form a point; the tip 60 may be shaped as an open tip, where an aperture is disposed in the jacket 16 at the tip 60; the tip 60 may be formed as a soft point, where the front core 12 or a malleable insert protrudes through an aperture in the jacket 16 to form the tip 60; or the tip 60 may be formed as a hollow point, where the forward end of the front core 12 or a malleable insert, exposed either by an open tip or by a soft point configuration, includes a recess formed therein. Accordingly, other embodiments are within the scope of the following claims.

What is claimed is:

1. A bullet comprising:

a front core;

a one-piece mid core that includes a substantially monolithic, non-tubular construction, the front core in tandem alignment with the mid core;

a rear core in tandem alignment with the mid core, the hardness of the mid core is greater than the hardness of the rear core;

a jacket enveloping the front core, the mid core and the rear core, the jacket having a nose portion, the front core being positioned adjacent to the nose portion;

an angularly indented rear portion forming a boat-tail; and a generally cylindrical sidewall disposed between the nose portion and the angularly indented rear portion, wherein the generally cylindrical sidewall is in contact with the mid core and the boat-tail is in contact with the rear core, the rear core being substantially contained within the boat-tail.

2. The bullet of claim 1, wherein the mid core and the rear core are substantially lead-free.

3. The bullet of claim 2, wherein the mid core has a weight of about 38 grains and is formed from:

a high-density constituent material selected from the group of tungsten, tungsten carbide, carballoy, and ferro-tungsten;

a second, lower-density constituent consisting of either a metallic matrix material or a plastic matrix material; and wherein the rear core has a weight of about 4.3 grains and is formed from tin or a tin base alloy.

4. The bullet of claim 1, wherein the rear core substantially fills the boat-tail.

5. The bullet of claim 1, wherein the front core is formed from steel.

6. The bullet of claim 5, wherein the mid core has a weight of about 30 grains and is formed from:

a high-density constituent material selected from the group of tungsten, tungsten carbide, carballoy, and ferro-tungsten;

a second, lower-density constituent consisting of either a metallic matrix material or a plastic matrix material; and wherein the rear core has a weight of about 4.3 grains and is formed from tin or a tin base alloy.

7. The bullet of claim 1, wherein the mid core is formed from:

a high-density constituent material selected from the group of tungsten, tungsten carbide, carballoy, and ferro-tungsten; and a second, lower-density constituent consisting of either a metallic matrix material or a plastic matrix material.

8. The bullet of claim 7, wherein the metallic matrix material is selected from the group consisting of: tin, zinc, iron, copper, and mixtures or alloys of one or more of the foregoing.

9. The bullet of claim 7, wherein the plastic matrix material is selected from the group consisting of: phenolics, epoxies, dialphthalates, acrylics, polystyrenes, polyethylene, or polyurethanes.

10. The bullet of claim 1, wherein the mid core is formed from one of: copper, bismuth, tin, gold, silver, pewter, bronze, and mixtures or alloys including one or more of the foregoing.

11. The bullet of claim 1, wherein the mid core is formed from an organic polymer filled with a metal.

12. The bullet of claim 1, wherein the rear core has a Brinell hardness less than about 50.

13. The bullet of claim 12, wherein the rear core is formed from tin or a tin base alloy.

14. The bullet of claim 12, wherein the rear core is formed from one of: copper, zinc, tin, and mixtures or alloys including one or more of the foregoing.

15. The bullet of claim 1, wherein a transition point between the generally cylindrical sidewall and the boat-tail is formed by a rebate in the generally cylindrical sidewall.

* * * * *